United States Patent [19]

Cahill et al.

[11] Patent Number: 4,834,116

[45] Date of Patent: May 30, 1989

[54] FORMING GROUPS OF CIGARETTES

[75] Inventors: Michael J. Cahill; David C. M. Carter, both of Coventry, United Kingdom; Michael D. Simcoe, Canberra, Australia

[73] Assignee: Molins PLC, Milton Keynes, England

[21] Appl. No.: 932,114

[22] Filed: Nov. 18, 1986

[30] Foreign Application Priority Data

Dec. 28, 1985 [GB] United Kingdom ..... 8529341

[51] Int. Cl.[4] ..... A24C 5/00; A24C 5/35

[52] U.S. Cl. ..... 131/282; 131/283

[58] Field of Search ..... 131/282, 283, 904; 209/535, 555, 602

[56] References Cited

U.S. PATENT DOCUMENTS 4,342,321 8/1982 Zullo ..... 131/283

4,363,332 12/1982 Preston et al. ..... 131/283

*Primary Examiner*—V. Millin

*Attorney, Agent, or Firm*—John C. Smith, Jr.

[57] ABSTRACT

Groups of cigarettes are formed by axially extracting cigarettes from the bases of two hoppers (10, 12), each having vertical columns (14, 20) spaced apart by a cigarette diameter. The columns of the hoppers are staggered so that a cigarette extracted from the rear hopper (12) enters the gap between adjacent cigarettes of the front hopper (10, FIG. 3). The base plate (22) of the front hopper is initially higher than the base plate (18) of the rear hopper to allow clearance during intercalation of the cigarettes.

21 Claims, 1 Drawing Sheet

FORMING GROUPS OF CIGARETTES

This invention relates to apparatus for forming groups of cigarettes or the like, particularly closely spaced parallel rows of cigarettes.

In the cigarette packaging industry it is common for single or multiple row batches of cigarettes to be formed by passing cigarettes down a hopper between a plurality of upright vanes to form single columns of cigarettes. The required number of cigarettes are then axially ejected from the columns at the base of the hopper.

A problem with such conventional batching arrangements is that although the vanes may be very thin near the base, the cigarettes to be ejected cannot be touching, so that it is invariably necessary to provide some means for laterally closing up the resultant groups of cigarettes.

Furthermore, since the distance between the walls of the vanes is constant whereas the thickness of the vanes themselves usually increases towards the top (due to the need for so-called agitating rollers for urging cigarettes into the columns), in a wide hopper arrangement the progressively less steep inclination of the columns of cigarettes towards the sides of the hopper results in those columns being inclined too close to the horizontal, so that it becomes difficult to produce a row of cigarettes wider than say twelve cigarettes.

According to a first aspect of the invention apparatus for forming groups of cigarettes comprises a front and a rear cigarette hopper, each hopper having vanes to form at least one column of cigarettes, the columns of the two hoppers being parallel and staggered by one cigarette diameter, and means for axially ejecting each lowermost cigarette from the rear hopper into a respective gap in the front hopper.

According to a second aspect of invention there is provided apparatus for forming rows of closely spaced cigarettes comprising a front hopper and a rear hopper axially aligned with the front hopper, each hopper having a base and vanes to separate adjacent cigarettes formed on the base by a gap of about one cigarette diameter, the vanes of the respective hoppers being staggered so that a cigarette in one hopper is aligned with a gap in the other hopper, and means for ejecting cigarettes axially from the rear hopper into the gaps in the front hopper and for ejecting the resulting row of cigarettes from the front hopper.

Advantageously the bases of the front and rear hoppers each have a base at a different level, the levels being spaced apart by a distance less than the diameter of a cigarette, and preferably by a distance less than one half the diameter of a cigarette. In this way cigarettes from the rear hopper can more easily clear the rear ends of the cigarettes in the front hopper.

The ejecting means may be a pusher bar extending across the combined width of the hoppers and operable to pass under each hopper. Preferably said pusher bar is trained between pairs of continuously moving conveyors, such as chain conveyors, so that it may pass continuously under the hoppers. Alternatively the ejecting means may be a reciprocating pusher extending into and under at least one hopper, and a conveyor means for further ejecting the group of cigarettes from the front hopper.

The invention will now be described, by way of example only, with reference to the accompanying drawings, in which.

Figure 1:
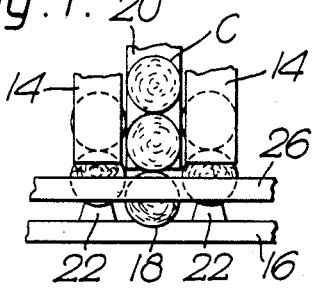
FIG. 1 is an end view of apparatus according to one embodiment of the invention.
Figure 2:
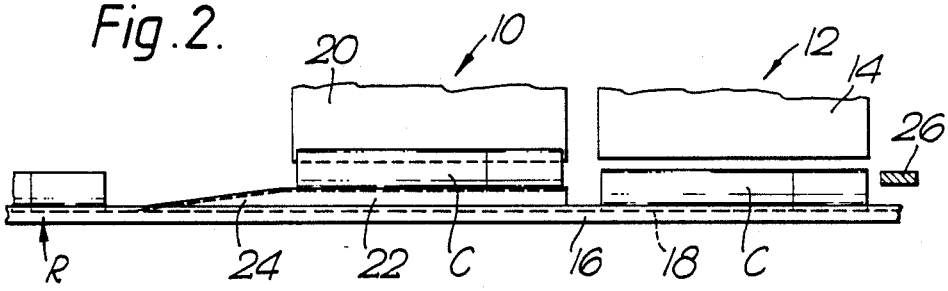
FIG. 2 is a side view of the apparatus drawn to a smaller scale.
Figure 3:
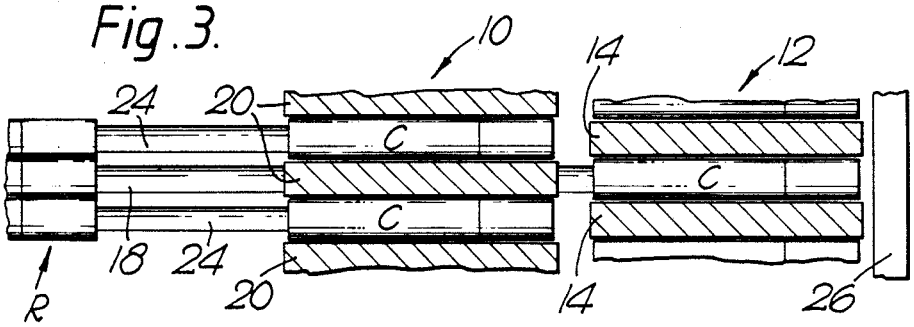
FIG. 3 is a plan view corresponding to FIG. 2.

Referring first to FIGS. 1 to 3 there is shown part of a cigarette hopper according to one embodiment of the invention, in which the reference numerals 10 and 12 respectively represent front and rear cigarette hoppers. The rear hopper 12 comprises a plurality of vertical vanes 14 (only two shown) each having a width slightly less than the diameter of a cigarette, and the spacing between the vanes being slightly greater than the diameter of a cigarette, so that the pitch between adjacent vanes corresponds to twice the diameter of a cigarette. Each pair of adjacent vanes 14 forms a vertical column of cigarettes C which are provided with just sufficient clearance between the walls of the vanes to that they are capable of freely descending.

The front hopper 10, arranged similar to the rear hopper, consists of vanes 20 corresponding to the vanes 14 in the rear hopper. However the front vanes 20 are staggered or offset relative to the rear vanes 14 by one cigarette diameter, so that each column of cigarettes in the rear hopper is aligned with a vane 20 in the front hopper.

Beneath the vanes 14 and 20 is a horizontal base plate 16 in which under each column there is formed a smooth groove or corrugation 18 (FIG. 1) in which rests the lowermost of the cigarettes of a column.

The bottom ends of the front vanes 20 are vertically spaced slightly more than the diameter of a cigarette from the bottom of the respective grooves 18, so that a cigarette from the rear hopper may pass along the groove under the vane 20. The corresponding vanes 14 of the rear hopper are similarly spaced from the base 16 by about one cigarette diameter.

Formed on the base plate 16 are grooved and raised supports or teeth 22 each at a position under one of the columns of cigarettes of the front hopper 10. Each tooth 22 tapers towards the front of the hopper 10 along an incline 24 down to the base plate 16, i.e. towards the left as viewed in FIGS. 2 and 3. Between the front vanes 20 the difference in height between the bottom of the grooves of the teeth 22 and the grooves 18 is somewhat less than one half the diameter of a cigarette, so that a lowermost cigarette resting on a tooth 22 under the front hopper is at the level between the lowermost two cigarettes of a column in the rear hopper, as can be seen in FIG. 1.

To the right of the rear hopper, as viewed in FIGS. 2 and 3, is a horizontal pusher bar 26 whose ends are connected to chain conveyors (not shown) of a type conventionally known in the art. The height of the pusher bar 26 is about half the diameter of a cigarette, and the chains (not shown) are moveable along a horizontal path so that in operation the pusher engages the rear filter end of each lowermost cigarette in the rear hopper, clearing the bottom of the vanes 14. Further movement of the pusher 26 brings each cigarette from the rear hopper into a position underneath the respective vane 20 of the front hopper. The pusher 26 now engages the lower half of the cigarettes in the front hopper, passing with sufficient clearance between the vanes 20 and the teeth 22.

As the pusher ejects the front and rear cigarettes out of the front hopper, each front cigarette descends down its respective incline 24 and comes down to the level of the rear cigarette, thus forming a single row R of closely-spaced laterally abutting cigarettes, as shown in FIGS. 2 and 3.

Figure 5:
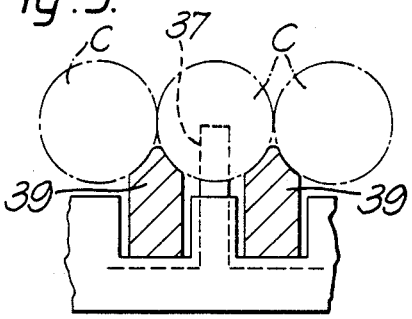
FIG. 5 is an enlarged section taken on the line V—V of FIG. 4.
Figure 4:
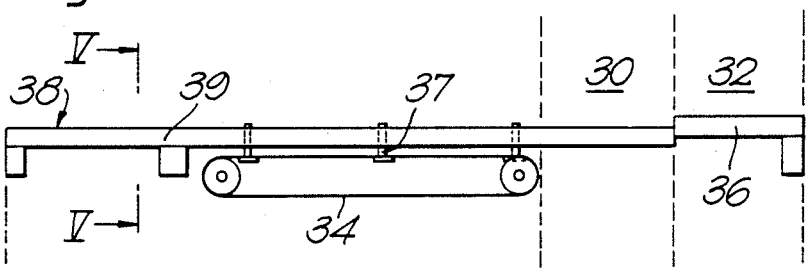
FIG. 4 is a side view of an alternative embodiment according to the invention.

Referring now to the alternative embodiment of FIGS. 4 and 5, the rear hopper 32 has its base 36 raised slightly above that of the front hopper 30 so that as cigarettes are pushed out of the rear hopper, to intercalate with the cigarettes of the front hopper, they drop down into alignment with the cigarettes in the front hopper. The resulting single row of cigarettes is then further pushed into the range of a conveyor 34 having flighted pushers 37 which continue to advance the rows of cigarettes to a delivery position 38. In this case the pushers on the conveyor 34 are vertical fingers 37 extending between slats 39, which are radiussed at the sides so that a cigarette C can sit in between two adjacent slats.

At the delivery position of the cigarettes, shown at 38 in FIG. 4, the groups of cigarettes may be transferred to a packaging machine which forms no part of the present invention.

Though only a small portion of the hoppers has been shown in FIGS. 1 and 3, they can be arranged to be of any desired width, for example so that thirty cigarettes can be ejected from each hopper at each stroke, resulting in a row of sixty cigarettes. It is is then desired to divide such a row into smaller groups it is only necessary to blank off the respective columns between adjacent vanes 14 and/or vanes 20 to produce the required gaps between groups.

It is possible to arrange for more than one row of cigarettes to be ejected from each hopper during a single operation, for example two rows at a time. In this case the pusher needs to be of greater height and the front vanes are required to be suitably raised. It is then necessary to ensure that the second lowermost cigarette in each column does not drop sideways into the space between such raised vanes.

We claim:

1. Apparatus for forming groups of cigarettes comprising a front and a rear cigarette hopper, each hopper having vanes to form at least one column of cigarettes, the vanes of the two hoppers being arranged such that the cigarettes of the columns of the two hoppers are parallel and the columns of the two hoppers are offset by one cigarette diameter with respect to each other such that said at least one column of said rear hopper is aligned with a respective vane of said front hopper, and means for axially ejecting each lowermost cigarette from the rear hopper into a respective gap in the front hopper.

2. Apparatus as claimed in claim 1 in which the front and rear hoppers each have a base at a different level, the levels being spaced apart by a distance less than the diameter of a cigarette.

3. Apparatus as claimed in claim 2 in which the bases are spaced apart by a distance less than one half the diameter of a cigarette.

4. Apparatus is claimed in claim 2 in which the bases of the two hoppers converge to the same level downstream of the front hopper.

5. Apparatus as claimed in claim 1 in which said ejecting means is a pusher bar extending across the combined width of the hoppers and operable to pass under each hopper.

6. Apparatus as claimed in claim 5 in which said pusher bar is trained between pairs of continuously moving conveyors.

7. Apparatus as claimed in claim 5 in which said ejecting means comprises a reciprocating pusher extending into and under at least one hopper, and a conveyor means for further ejecting the group of cigarettes from the front hopper.

8. Apparatus as claimed in claim 1 in which the ejecting means is of such a configuration that more than one cigarette is ejected from a hopper column at each operation thereof.

9. Apparatus for forming rows of closely spaced cigarettes comprising a front hopper and a rear hopper axially aligned with the front hopper, each hopper having a base and vanes to separate adjacent cigarettes formed on the base by a gap of about one cigarette diameter, the vanes of the respective hoppers being offset with respect to each other so that a cigarette in one hopper is aligned with a gap in the other hopper, and means for ejecting cigarettes axially from the rear hopper into the gaps in the front hopper and for ejecting the resulting row of cigarettes from the front hopper.

10. Apparatus as claimed in claim 8 in which one or more selected vanes are blanked off to prevent a cigarette descending to the base at such location, so that a plurality of rows of fewer cigarettes are formed.

11. Apparatus for forming groups of cigarettes comprising a front and a rear cigarette hopper, said rear hopper having at least two vanes spaced from each other to form therebetween at least one column of cigarettes, said front hopper having at least three vanes spaced from each other to form therebetween at least two columns of cigarettes with a gap between adjacent columns of cigarettes, the vanes of the two hoppers being arranged such that the cigarettes of the columns of the two hoppers are parallel to each other and the columns of the two hoppers are offset by one cigarette diameter with respect to each other such that each said at least one column of said rear hopper is aligned with a respective vane of said front hopper, base means for supporting the lowermost cigarette in each column of both said front and rear hoppers, said base means being spaced from the lower edges of said at least three vanes of said front hopper, and means for axially ejecting at least the lowermost cigarette of said at least one column from said rear hopper into a respective gap between said at least two columns in said front hopper.

12. Apparatus as claimed in claim 11 in which said base means is adapted to support the lowermost cigarette of each of said at least two columns of said front hopper and the lowermost cigarette of said at least one column of said rear hopper at different levels, said levels being spaced apart by a distance less than the diameter of a cigarette.

13. Apparatus as claimed in claim 12 in which said levels are spaced apart by a distance less than one-half the diameter of a cigarette.

14. Apparatus as claimed in claim 12 in which said ejecting means is adapted to axially eject said at least the lowermost cigarette of said at least one column ejected from said rear hopper and at least the lowermost cigarette of each of said at least two columns of said front hopper from said front hopper to a predetermined position downstream from said front hopper and in which said base means is adapted to support said at least the lowermost cigarette, ejected from said at least one column of said rear hopper, at the same level in said front hopper as in said rear hopper and to bring all of said at least the lowermost cigarettes to the same level at said predetermined position when all of said at least the lowermost cigarettes from the respective columns of said front and rear hoppers are ejected to said predetermined position.

15. Apparatus as claimed in claim 14 in which said base means is spaced from the lower edges of said at least two vanes of said rear hopper and said ejecting means is a pusher bar extending across the combined width of the hoppers and operable to pass between said base means and each hopper.

16. Apparatus as claimed in claim 15 in which said pusher bar is trained between pairs of continuously moving conveyors.

17. Apparatus as claimed in claim 14 in which said ejecting means comprises a reciprocating pusher extending under at least one of said hoppers and conveyor means for further ejecting all of said at least the lowermost cigarettes from said front hopper to said predetermined position.

18. Apparatus as claimed in claim 11 in which said ejecting means is adapted to eject more than one cigarette is ejected from each column of each hopper at each operation thereof.

19. Apparatus as claimed in claim 11 in which each of said vanes has a width slightly less than the diameter of a cigarette and the spacing between the vanes of each of said hoppers is slightly greater than the diameter of a cigarette such that the pitch between adjacent of said vanes corresponds to twice the diameter of a cigarette.

20. Apparatus as claimed in claim 19 in which the lower edges of said at least three vanes of said front hopper are spaced from said base means by a distance slightly more than the diameter of a cigarette.

21. Apparatus as claimed in claim 19 in which the lower edges of said at least two vanes of said rear hopper are spaced about one cigarette diameter from said base means.

* * * * *